US011260652B2

(12) United States Patent
Gracia Verdugo et al.

(10) Patent No.: US 11,260,652 B2
(45) Date of Patent: Mar. 1, 2022

(54) PRINT HEAD NOZZLE SPITTING

(71) Applicant: HEWLETT-PACKARD DEVELOPMENT COMPANY, L.P., Spring, TX (US)

(72) Inventors: Antonio Gracia Verdugo, Sant Cugat del Valles (ES); Pau Costal Fornells, Sant Cugat del Valles (ES); Norman Guillo, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 420 days.

(21) Appl. No.: 16/337,751

(22) PCT Filed: Jan. 27, 2017

(86) PCT No.: PCT/US2017/015285
§ 371 (c)(1),
(2) Date: Mar. 28, 2019

(87) PCT Pub. No.: WO2018/140027
PCT Pub. Date: Aug. 2, 2018

(65) Prior Publication Data
US 2021/0283906 A1 Sep. 16, 2021

(51) Int. Cl.
*B41J 2/045* (2006.01)

(52) U.S. Cl.
CPC ..... *B41J 2/04533* (2013.01); *B41J 2/04586* (2013.01)

(58) Field of Classification Search
CPC .. B41J 2/04505; B41J 2/0458; B41J 2/04581; B41J 2/04503; B41J 2/04506; B41J 2/04508; B41J 2/0451; B41J 2/04513; B41J 2/125; B41J 2002/022; B41J 2/09; B41J 2/12; B41J 2/04565; B41J 2/04566;
(Continued)

(56) References Cited

U.S. PATENT DOCUMENTS 6,183,062 B1 2/2001 Curtis et al.
6,250,739 B1 6/2001 Serra
6,283,572 B1 9/2001 Kumar
(Continued)

FOREIGN PATENT DOCUMENTS

JP 2001315318 A 11/2001
WO WO-2015055226 A1 4/2015

*Primary Examiner* — Kristal Feggins
(74) *Attorney, Agent, or Firm* — HP Inc. Patent Department

(57) ABSTRACT

A method is disclosed. The method may involve obtaining information indicative of a number of printing passes of a print head to print a swath on a printable medium. The method may comprise determining that the print head is to perform a particular printing pass which is one of: a printing pass during which an amount of print agent to be deposited from nozzles of the print head differs, by an amount that exceeds a defined threshold, from an amount of print agent to be deposited from the nozzles during a printing pass immediately preceding said particular printing pass; and a printing pass to print a swath which is the first of a plurality of adjacent swaths in which each swath has an area coverage exceeding a defined threshold. The method may comprise preparing, based on said obtained information, a schedule for a nozzle spitting procedure to commence before the print head performs the particular printing pass.

20 Claims, 6 Drawing Sheets

(58) Field of Classification Search
CPC . B41J 2/04556; B41J 2/08; B41J 2/085; B41J 2/04533; B41J 2/04586
See application file for complete search history.

(56) References Cited

U.S. PATENT DOCUMENTS

| | | | |
|---|---|---|---|
| 6,293,646 | B1 | 9/2001 | Beachnau et al. |
| 6,450,613 | B1 | 9/2002 | Rietbergen |
| 7,771,005 | B2 | 8/2010 | Jung et al. |
| 2008/0266343 | A1 | 10/2008 | Borrell et al. |

PRINT HEAD NOZZLE SPITTING

BACKGROUND

A printing apparatus may include a print head having a plurality of nozzles, via which print agent may be delivered onto a printable substrate, such as a sheet of paper. Various tasks, such as maintenance tasks, may be performed to the nozzles of the print head in order to maintain their efficacy.

One such maintenance task might include spitting print agent from the nozzles. In some examples, spitting may be performed prior to a print job being commenced and/or at intervals during the print job. Spitting may serve to clean the nozzles and/or may help to prevent print agent from drying within the nozzles, and causing the nozzles to become blocked.

BRIEF DESCRIPTION OF DRAWINGS

Examples will now be described, by way of non-limiting example, with reference to the accompanying drawings, in which.

DETAILED DESCRIPTION

Figure 1A:
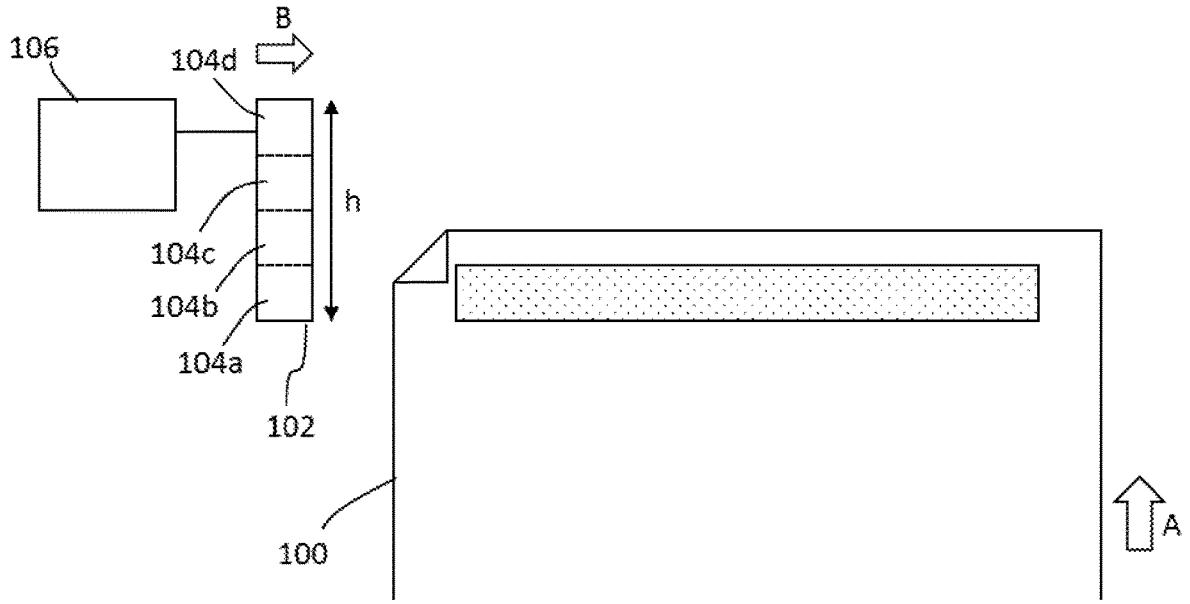
FIG. 1 is a schematic illustration of an example of four stages of a print job using a printing apparatus.
Figure 1B:
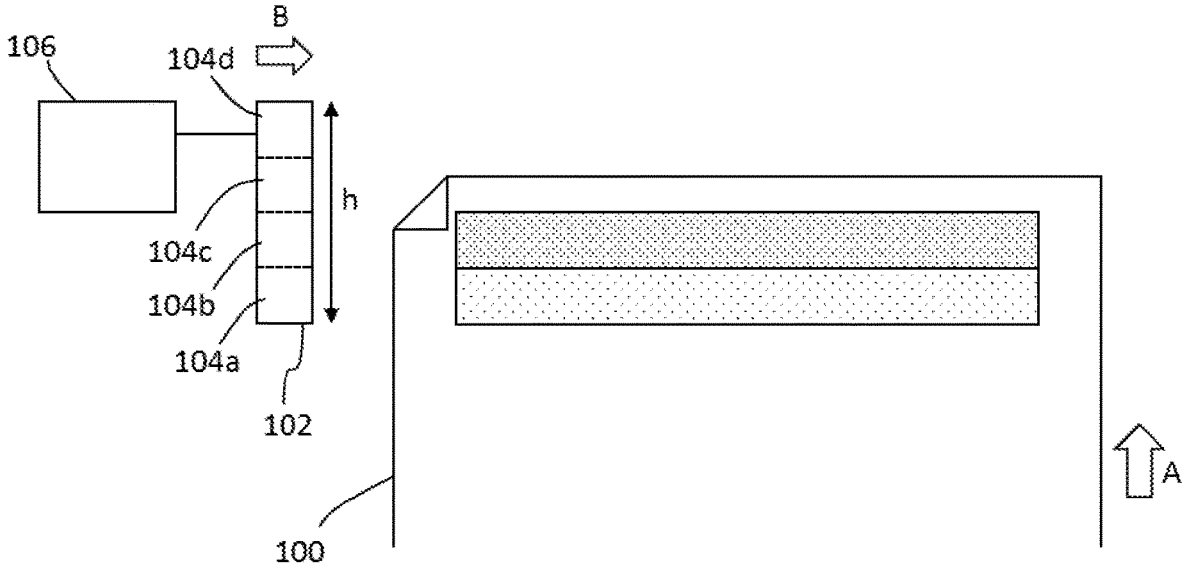
Figure 1C:
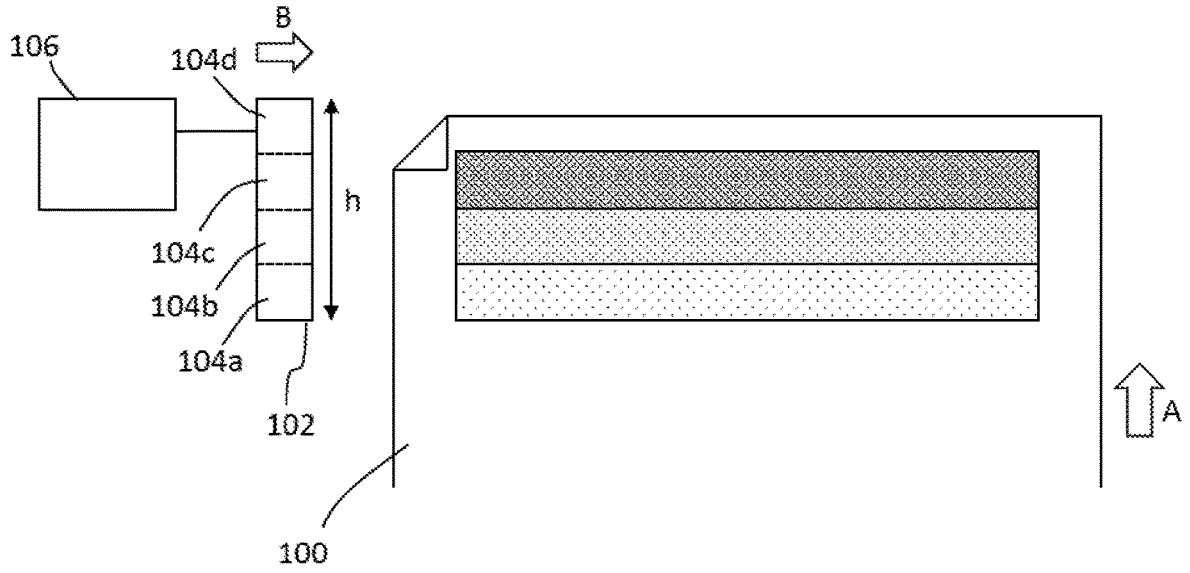
Figure 1D:
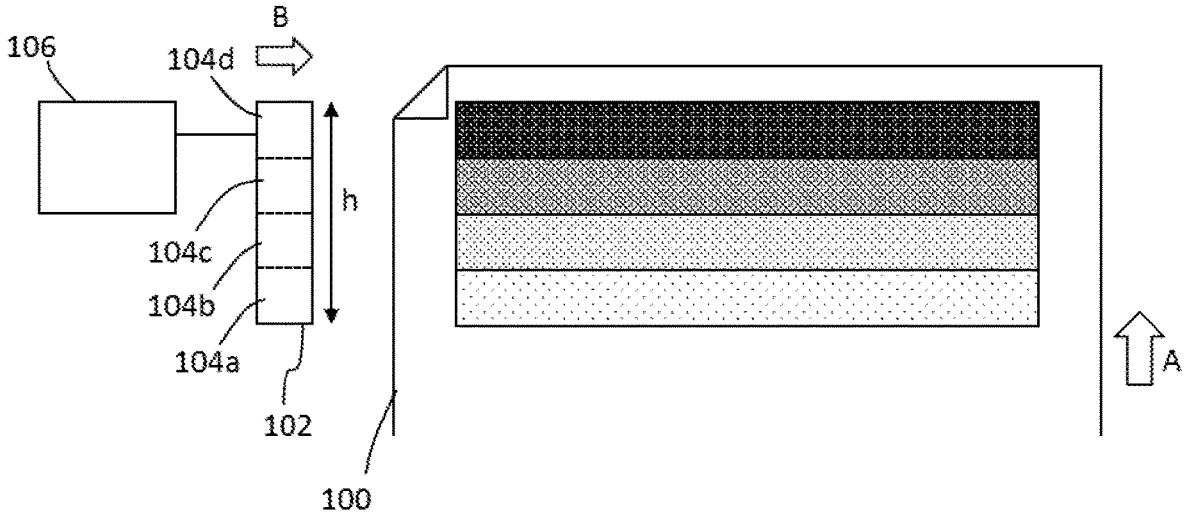

A printing apparatus may be used to deliver print agent, such as ink, onto a printable medium, such as a sheet of paper, as the substrate is moved over a platen. Print agent may be contained in a reservoir. Print agent may be delivered by a nozzle of a print agent distributor, or print head. For example, ink may be delivered to a print head from an ink reservoir fluidly connected to the print head. Ink may be deposited via nozzles of the print head onto the printable medium in a pattern according to print job data processed, for example by a processing resource. It will be appreciated that the invention can be incorporated in a 2D printing system or a 3D printing system (e.g. an additive manufacturing system).

FIG. 1 is a schematic showing an example of four stages of a print job using a print apparatus. In FIGS. 1*a* to 1*d*, a portion of a print apparatus is shown.

A print apparatus is to print onto a substrate 100. The substrate 100 may be any type of printable medium (also called a print medium), and may be a sheet of material, such as paper, capable of receiving print agent, such as ink or build material. In other examples, the substrate 100 may be a sheet of cardboard, wood, glass, metal, plastics material. The substrate 100 may be any shape.

The substrate 100 may be moved, or advanced, for example over a platen or print bed (not shown in FIG. 1) using a substrate advancer (not shown in FIG. 1), which may include a roller and/or a wheel. In the example shown in FIG. 1, the direction of movement of the substrate 100 is shown by arrow A.

The print apparatus further includes a print agent distributor, or print head 102, having a plurality of nozzles (not shown) via which print agent may be delivered onto the substrate 100. As used herein, "delivering" print agent includes firing, ejecting or otherwise depositing print agent or ink. The selection of the nozzles via which print agent is to be delivered is made by a control unit, or processing apparatus (not shown), and is made based on the pattern or image to be printed. The nozzles are, in some examples, arranged in an array, and may be arranged in rows (i.e. parallel to the direction indicated by arrow B in FIG. 1) and columns (i.e. parallel to the direction indicated by arrow A in FIG. 1). During printing, the print head 102 moves over the substrate 100 in the direction of arrow B, which is perpendicular to the direction of movement of the substrate.

The array of nozzles in the print head 102 may be arranged in subgroups or subsets. For example, the nozzles of the print head 102 may be arranged in four subsets, as shown in FIG. 1. In the example shown in FIG. 1, a first subset 104*a* of nozzles is located at a first position in the print head, a second subset 104*b* of nozzles is located at a second position in the print head, a third subset 104*c* of nozzles is located at a third position in the print head and a fourth subset 104*d* of nozzles is located at a fourth position in the print head. Each subset of nozzles may be controlled to deliver print agent independently of the others, or two or more of the bands of nozzles may be controlled to deliver print agent simultaneously.

The print head 102 has a length, also called a "height", h, and the length h corresponds to a width of a strip of print agent which may be printed by the print head if all of the nozzles were to fire (i.e. deposit print agent) during a printing pass over the substrate 100. The area (for example on a substrate) that can be printed by the print head 102 in a single printing pass (if all nozzles were to fire) may be called a swath. In this context, the number of rows (which may be measured in rows of nozzles or rows of print agent in a resulting pattern/image, for example pixel rows) that may be printed may be referred to as a "swath height". The term "printing pass" is intended to mean a movement of the print head 102 over the substrate 100 during which print agent is deposited. In some examples, print agent may be delivered when the print head 102 moves in the direction B (i.e. from left to right in FIG. 1). After the pass, the print head 102 may return to its starting position (i.e. its position in FIG. 1) before performing a second pass. In other examples, print agent may also be deposited while the print head 102 moves in the direction opposite to the arrow B (i.e. from right to left in FIG. 1). In such an example, each time the print head 102 travels completely over the substrate 100 may be a printing pass.

In some examples, the print head 102 may be such that the area to be printed by all of the nozzles, or by all of the subsets of nozzles, is completed after multiple printing passes of the print head. In other words, the swath is completed after multiple passes of the print head 102 over the substrate 100. By using such so-called "multi-pass printing", the resulting print quality may be higher than can be achieved using a single-pass print mode, as a greater amount of print agent may be delivered to the substrate 100. Further, the print agent delivered to the substrate may be able to dry (at least partially) between each pass of the print head 102, meaning the interaction between fresh print agent delivered during each pass of the print head with print agent already delivered to the substrate 100 is different to the interaction between print agent and the substrate if the print agent is delivered during a single pass.

FIGS. 1*a* to 1*d* show various stages of a four-pass print job as the substrate 100 is advanced. Thus, in this example, a swath is completed after four passes of the print head 102 over the substrate 100 (during which print agent is delivered). Print agent may, in some examples, be delivered onto the substrate by a different band of nozzles during each pass. In the example shown, print agent is to be delivered (printed) onto the substrate 100 by the first subset 104*a* of nozzles during the first pass (as in FIG. 1*a*), by the first and second subsets 104*a*, 104*b* of nozzles during the second pass (as in FIG. 1*b*), by the first, second and third subsets 104*a*, 104*b*, 104*c* of nozzles during the third pass (as in FIG. 1*c*), and by the first, second, third and fourth subsets 104*a*, 104*b*, 104*c*, 104*d* of nozzles during the fourth pass (as in FIG. 1*d*). The substrate may be advanced by a defined distance between each pass.

The print apparatus shown in FIG. 1 also includes a scheduler 106 connected to the print head 102. The scheduler 106 may comprise computer-implemented instructions executed by a processing resource associated with the printing apparatus. The scheduler 106 schedules maintenance procedures to be performed in relation to the print head 102, in relation to nozzles of the print head and/or in relation to other components of the printing apparatus. In some examples, the scheduler 106 may schedule a spitting procedure for the nozzles. Spitting may be carried out by a nozzle of the print head 102 in order to clean the nozzle and/or to prevent print agent from drying within the nozzle. Spitting involves depositing print agent from a nozzle in an area away from the substrate 100. In other words, a drop of print agent may be deposited from a nozzle into a spitting region, such as a spittoon, so that the nozzle is able to deposit print agent without causing the print agent to be deposited onto the substrate. In some example, a nozzle may deposit more than one drop. In some examples, such a spitting region may be positioned to one side of a region through which the substrate 100 passes to be printed. For example, a spittoon may be located in the position at which the print head 102 is shown in FIG. 1.

When a nozzle is caused to deposit print agent, a temperature of the nozzle is caused to increase due to a voltage applied to a component in the nozzle that causes the nozzle to fire. Consequently, a temperature of print agent passing through, or deposited from, a warm nozzle is also caused to increase. A weight of relatively warmer drops of print agent is greater than a weight of relatively cooler print agent and, therefore, the amount of print agent that may be deposited by a nozzle during a single printing pass may depend on the temperature of the nozzle. Thus, during a printing pass performed while a nozzle is relatively cooler (e.g. a nozzle which has not deposited print agent for some time), less print agent may be delivered onto the substrate 100 than a nozzle which is relatively warmer (e.g. a nozzle which has deposited print agent in an immediately preceding printing pass. Similarly, if a particular swath printed by the print head 102 is printed with relatively cooler nozzles, then less print agent may be deposited onto the substrate 100 than in a swath printed with relatively warmer nozzles. The difference in deposited print agent between the two swaths may result in a noticeable difference in a colour, shade and/or hue of the resulting printed image or pattern.

Performing a spitting procedure on particular nozzles of the print head 102 may also cause a temperature of those nozzles to increase. Thus, the scheduler 106 may, in some examples, schedule particular nozzles to undergo a spitting procedure prior to a particular printing pass in which those particular nozzles are to deposit print agent. Such a spitting procedure may cause the temperature of those particular nozzles to increase to a temperature similar to a temperature at which they would be if they had deposited print agent in a printing pass immediately preceding the particular printing pass.

A printing pass during which nozzles of the print head 102 may be relatively cooler may occur at a number of occasions during a print job. For example, when a print head is to print a swath which is a first swath to be printed in a print job (e.g. a first swath to be printed on a substrate 100), some nozzles of the print head 102 may be relatively cooler than those nozzles when printing a subsequent swath. In other examples, when a print head is to perform a particular printing pass to print a swath in which an amount of print agent to be deposited is significantly less than an amount of print agent to be deposited during the printing pass immediately preceding the particular printing pass, some nozzles of the print head 102 may be relatively hotter than those nozzles when printing a subsequent swath. Similarly, when a print head is to perform a particular printing pass to print a swath in which an amount of print agent to be deposited is significantly more than an amount of print agent to be deposited during the printing pass immediately preceding the particular printing pass, some nozzles of the print head 102 may be relatively cooler than those nozzles when printing a subsequent swath. In such cases, the scheduler 106 may schedule spitting procedures to be performed on particular nozzles of subsets of nozzles between printing passes of the print head 102, to reduce the change in temperature in nozzles between printing passes.

Examples of a method of scheduling a spitting procedure are discussed below with reference to FIGS. 2 to 6.

Figure 2:
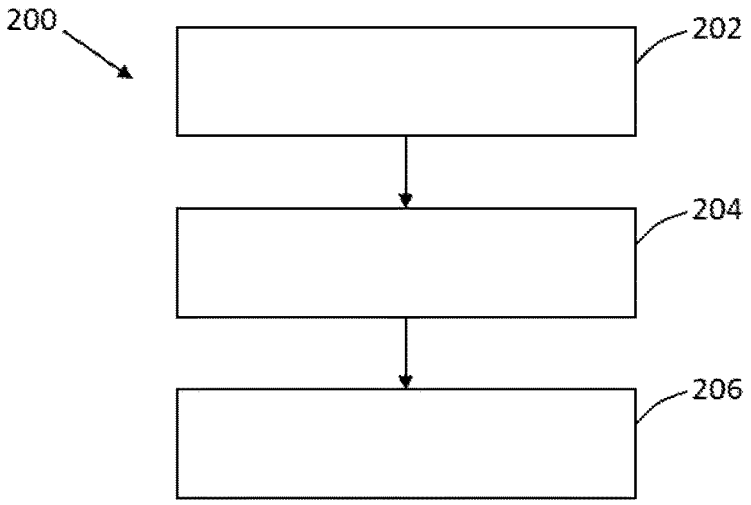
FIG. 2 is a flowchart of an example of a method of controlling a print head of a printing apparatus.

FIG. 2 is a flowchart of an example of a method 200 for controlling a print head of a printing apparatus. More particularly, the method 200 may be for scheduling a spitting procedure for a print head 102. The method 200 comprises, at block 202, obtaining information indicative of a number of printing passes of a print head 102 to print a swath on a printable medium 100. The information may be obtained, for example, through a user input. In some examples, the information may be obtained from interrogating print job data relating to a print job to be performed by the printing apparatus. For example, if a particular print job is to be performed to a highest possible standard, resulting in a highest possible quality print, then print head 102 may be caused to perform a relatively larger number of printing passes to print a swath than in a print job to be performed to a low quality, such as a draft print.

The method 200 further comprises, at block 204, determining that the print head is to perform a particular printing pass which is one of: (i) a printing pass during which an amount of print agent to be deposited from nozzles of the print head differs, by an amount that exceeds a defined threshold, from an amount of print agent to be deposited from the nozzles during a printing pass immediately preceding said particular printing pass; and (ii) a printing pass to print a swath which is the first of a plurality of adjacent swaths in which each swath has an area coverage exceeding a defined threshold.

Determining that the print head is to perform a particular printing pass that falls under the conditions set out in either (i) or (ii) above may be performed by interrogating or examining the print job data associated with the print job to be performed. The print job data may include details of which nozzles of the print head 102 are to deposit print agent during particular printing passes of the print head. The print job data may also include details of an amount of print agent (e.g. a number of drops of print agent) and a nature of the print agent (e.g. a colour of print agent) to be deposited during each printing pass. Thus, the print job data may include an indication of whether any of the printing passes to be performed by the print head 102 during the print job are printing passes that fall under condition (i) or condition (ii) above.

In some examples, the determining (block 204) may involve a processor performing a "density counting" procedure to estimate an amount of print agent that will be printed onto the substrate 100 during each printing pass of the print head 102. The processor, which may comprise a processing resource in or associated with the printing apparatus, may execute instructions which analyse print data associated with a print job to be performed. The density counting procedure may, in some examples, involve determining an amount of print agent (e.g. a density of print agent) to be deposited within a region of a defined width (e.g. 64, 128, 256 or 512 pixels) of the substrate 100 by a row of nozzles. If it is determined that an amount of print agent to be deposited is the same for a plurality of adjacent regions and for a plurality of adjacent rows, then it may be determined that the region is part of an area fill region. The density counting procedure may be performed prior to performing the print job, or while the print job is being performed. In some examples, the density counting procedure enable a determination of the amount of print agent to be printed several (e.g. thirty) swaths in advance of them being printed.

With regard to condition (i), an amount of print agent to be deposited from nozzles of the print head during a particular printing pass may differ from an amount of print agent to be deposited from the nozzles during a printing pass immediately preceding the particular printing pass when, for example, the print head is to perform a printing pass that includes a beginning or an end of an unprinted region (i.e. a region in which no print agent is deposited onto the substrate 100) within an area fill region (i.e. a region in which print agent is deposited onto the substrate so as to fill an area). Such examples are shown in FIGS. 3 and 4.

Figure 3:
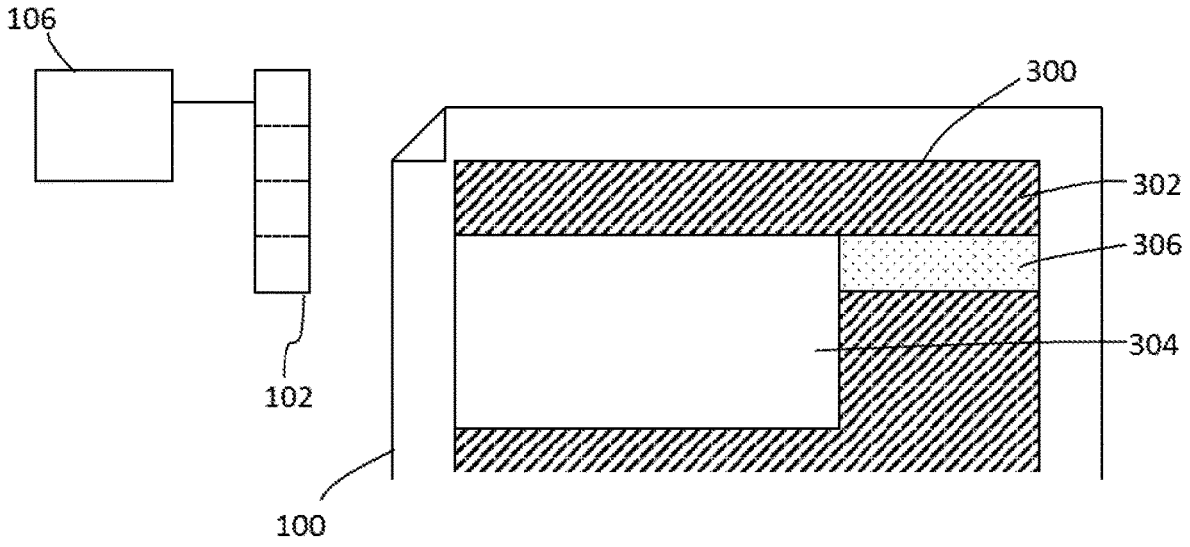
FIG. 3 is a schematic illustration of an example of a pattern to be printed on a substrate, and a portion of a printing apparatus.

FIG. 3 shows, schematically, an example of a pattern 300 to be printed on a substrate, and a portion of a printing apparatus. The pattern 300 in FIG. 3 includes an area fill region 302 and an unprinted region 304. A stippled band 306 indicates a portion of the pattern 300 which, to print, involves the print head 102 performing a printing pass during which an amount of print agent to be deposited from nozzles of the print head is significantly less than an amount of print agent to be deposited from the nozzles during the immediately preceding printing pass. During the printing pass to be performed when printing the band 306, no print agent is to be deposited onto the substrate 100 in the unprinted region 304 and, therefore, relatively less print agent is to be deposited onto the substrate during that printing pass than during the printing pass to print the swath immediately preceding it (above, in FIG. 3), which includes a printed area fill region across an entire printable area of the substrate 100.

Figure 4:
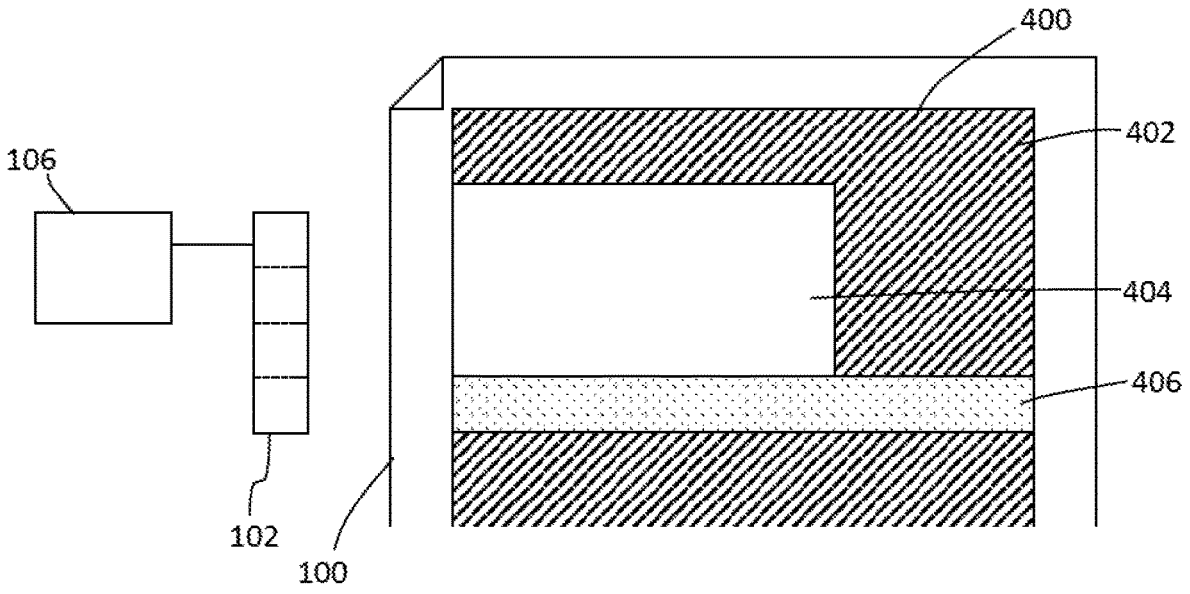
FIG. 4 is a schematic illustration of a further example of a pattern to be printed on a substrate, and a portion of a printing apparatus.

A further example of a print job which includes a printing pass which satisfies condition (i) is shown in FIG. 4. FIG. 4 shows, schematically, an example of a pattern 400 to be printed on a substrate 100, and a portion of a printing apparatus. The pattern 400 in FIG. 4 includes an area fill region 402 and an unprinted region 404. A stippled band 406 indicates a portion of the pattern 400 which, to print, involves the print head 102 performing a printing pass during which an amount of print agent to be deposited from nozzles of the print head is significantly greater than an amount of print agent to be deposited from the nozzles during the immediately preceding printing pass. In this example, the particular printing pass is the first printing pass to deposit print agent over entire printable width of the substrate 100 following the printing of the last swath to include the unprinted region 404. Thus, during the printing pass to be performed when printing the band 406, relatively more print agent is to be deposited onto the substrate 100 during that printing pass than during the printing pass to print the swath including the unprinted region immediately preceding it (above, in FIG. 4).

Condition (i) may be satisfied if the difference between the amount of print agent to be deposited from nozzles in the particular printing pass and the immediately preceding printing pass exceeds a defined threshold. In some examples, the defined threshold may be a difference of 50%. In other examples, the defined threshold may be a different threshold, such as a difference of 30%, 40%, 60% or 70%. The defined threshold may, in some examples, be defined by a user. When the print job data is examined in order to determine whether the print job is to include a particular printing pass that falls under the conditions set out in either (i) or (ii) above, a determination may be made as to whether or not the difference between the amount of print agent to be deposited from nozzles in the particular printing pass and the immediately preceding printing pass exceeds the defined threshold.

With regard to condition (ii), a particular printing pass may comprise a printing pass to print a swath which is the first of a plurality of adjacent swaths in which each swath has an area coverage exceeding a defined threshold if, for example, the plurality of adjacent swaths is an area fill region at the beginning of a print job, or at the beginning of a substrate to be printed. Such an example is shown in FIG. 5.

Figure 5:
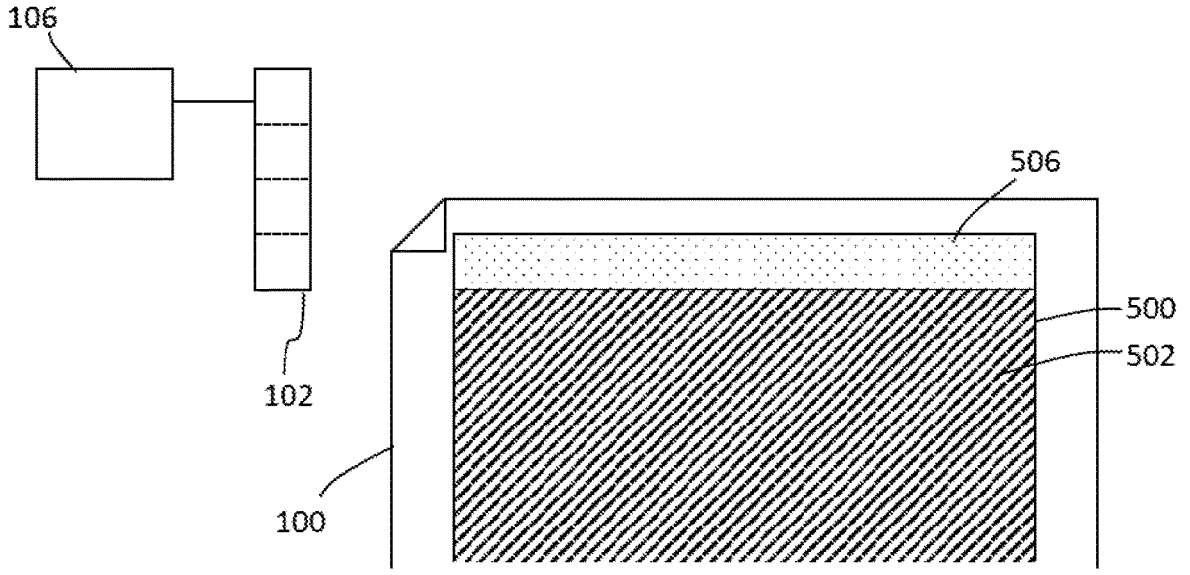
FIG. 5 is a schematic illustration of a further example of a pattern to be printed on a substrate, and a portion of a printing apparatus.

FIG. 5 shows, schematically, an example of a pattern 500 to be printed on a substrate, and a portion of a printing apparatus. The pattern 500 in FIG. 5 includes an area fill region 502 (i.e. an area comprising a plurality of adjacent swaths in which each swath has a large area coverage). A stippled band 506 indicates a portion of the pattern 500 which represents the first swath of the area fill region 502. In other words, in this example, no printing is performed by the print head 102 in the region immediately preceding (above, in FIG. 5) the swath to be printed in the region of the band 506.

The area to be printed in the pattern 500 may be considered to be an area fill region 502 if the amount of print agent to be delivered by the print head 102 in each swath is above a defined threshold, or if each swath in the plurality of adjacent swaths has an area coverage that exceeds a defined threshold. For example, if each swath in the plurality of adjacent swaths is to include a printed area coverage of more than 80% of the area that could be printed, then the condition (ii) may be met. In some examples, the defined threshold may be 50%, 60%, 70%, 90% or 95% of the area that could be printed. In other examples, the defined threshold for meeting condition (ii) may be a different threshold.

Referring again to FIG. 2, the method 200 further comprises, at block 206, preparing, based on said obtained information, a schedule for a nozzle spitting procedure to commence before the print head performs the particular printing pass. Thus, when it is determined that the print job is to include a particular printing pass that satisfies either of the conditions (i) or (ii), then the information regarding the number of printing passes of the print job is used to schedule a spitting procedure. In order to bring nozzles, or subsets of nozzles up to an intended temperature prior to printing the particular printing pass, the spitting procedure is scheduled to commence before the particular printing pass is performed.

In some examples, the subsets of nozzles may be scheduled to spit print agent (i.e. deposit print agent in an area which is not onto the substrate 100) at different times. For example, in a printing apparatus printing in a four-pass print mode, a first subset of nozzles may be scheduled to perform a spitting procedure prior to a first printing pass, a second subset of nozzles may be scheduled to perform a spitting procedure after the first printing pass and prior to a second printing pass, a third subset of nozzles may be scheduled to perform a spitting procedure after the second printing pass and prior to a third printing pass, and a fourth subset of nozzles may be scheduled to perform a spitting procedure after the third printing pass and prior to a fourth printing pass. In this way, the nozzles of each subset of nozzles may undergo a spitting procedure, thereby increasing in temperature, prior to the printing pass in which they are to deposit print agent onto the substrate 100.

Thus, in examples in which the print head 102 comprises a plurality of subsets of nozzles, preparing a schedule (block 206) may comprise scheduling a first subset of the plurality of subsets of nozzles to spit a first amount of print agent prior to the particular printing pass; and scheduling a second subset of the plurality of subsets of nozzles to spit a second amount of print agent prior to the particular printing pass. In some examples, the first amount may be different from the second amount.

In an example in which condition (i) is met (for example, as shown in FIG. 3), the second amount may be less than the first amount. In other words, in some examples, the particular printing pass may comprise a printing pass during which an amount of print agent to be deposited from nozzles of the print head differs, by an amount that exceeds a defined threshold, from an amount of print agent to be deposited from the nozzles during a printing pass immediately preceding said particular printing pass. In such examples, the second amount may be less than the first amount.

Table 1 below includes an example of a number of drops of print agent to be deposited (during a spitting procedure) from each nozzle in a particular subset of nozzles in a scenario such as that shown in FIG. 3. In the example, the print head 102 comprises four subsets of nozzles, such that four passes of the print head depositing print agent would cause a single swath to be formed on the substrate 100. Pass 1 is considered to be the particular printing pass determined at block 204 of the method 200. In this example, therefore, pass 1 is considered to be the first printing pass of the print head to print the first swath in the band 306, which includes the unprinted region 304.

TABLE 1

| Nozzle Subset | Drops to spit prior to pass 1 | Drops to spit prior to pass 2 | Drops to spit prior to pass 3 | Drops to spit prior to pass 4 | Drops to spit prior to pass 5 | Drops to spit prior to pass 6+ |
|---|---|---|---|---|---|---|
| 1 | 400 | 400 | 400 | 400 | 300 | 200 |
| 2 | 20 | 400 | 400 | 400 | 300 | 200 |
| 3 | 20 | 20 | 400 | 400 | 300 | 200 |
| 4 | 20 | 20 | 20 | 400 | 300 | 200 |

In this example, in the printing passes prior to the particular printing pass (i.e. pass 1), all of the subsets of nozzles have deposited print agent onto the substrate 100 to create the area fill region 302. When the print head is to print the swath corresponding to the band 306, the amount of print agent to be deposited reduces significantly due to the unprinted region 304 to be included in the resulting printed pattern. Therefore, prior to pass 1 (the particular pass), during which the first subset of nozzles would deliver significantly less print agent than in the preceding printing pass, spitting is performed by the nozzles in the first subset of nozzles to at least approximately maintain a temperature in the nozzles. A relatively large amount of print agent is to be deposited from the first subset of nozzles (400 drops from each nozzle in this example) compared to the amount of print agent to be deposited from the other subsets of nozzles (20 drops from each nozzle in this example). A small amount of print agent is to be deposited from the second, third and fourth subsets of nozzles to help maintain good working order of the nozzles in those subsets; for example, to prevent print agent from drying and blocking the nozzles.

After pass 1, and prior to pass 2, during which the second subset of nozzles is to deposit print agent onto the substrate 100 in the band 306, nozzles of the second subset are to spit a relatively large amount of print agent (400 drops from each nozzle in this example) along with the nozzles of the first subset. Nozzles of the third and fourth subsets are to again deposit a relatively small amount of print agent (20 drops from each nozzle in this example) as those nozzles are not to deposit print agent onto the substrate during the second pass.

Similarly, after pass 2, and prior to pass 3, during which the third subset of nozzles is to deposit print agent onto the substrate 100 in the band 306, nozzles of the third subset are to spit a larger amount (400 drops) and after pass 3, and prior to pass 4, during which the fourth subset of nozzles is to deposit print agent onto the substrate 100 in the band 306, nozzles of the fourth subset are to spit a larger amount (400 drops). Thus, prior to the fourth pass, all of the subsets of nozzles are to spit a large amount of print agent, as all of the subsets of nozzles are to be printing in the part of the pattern 300 next to the unprinted region 304.

After pass 4, the amount of print agent to be spit by each nozzle may be gradually reduced. In this way, the amount of print agent to be spit (and therefore wasted), may be reduced without causing any sharp transitions in the temperature of the nozzles.

Thus, preparing a schedule (block 206 of method 200) may further comprise scheduling the first subset of the plurality of subsets of nozzles to spit a third amount of print agent after the particular printing pass, and prior to a printing pass immediately following the particular printing pass; and scheduling the second subset of the plurality of subsets of nozzles to spit a fourth amount of print agent after the particular printing pass, and prior to the printing pass immediately following the particular printing pass. In some examples, such as the example discussed above with reference to Table 1, the third amount may be the same as the fourth amount.

The number of drops to be deposited from each subset of nozzles during the spitting procedure may be selected based on the change in the amount of print agent to be deposited between the particular printing pass and the printing pass immediately preceding the particular printing pass.

In a further example in which condition (i) is met (for example, as shown in FIG. 4), the second amount may be greater than the first amount. In other words, in some examples, the particular printing pass may comprise a printing pass during which an amount of print agent to be deposited from nozzles of the print head differs, by an amount that exceeds a defined threshold, from an amount of print agent to be deposited from the nozzles during a printing pass immediately preceding said particular printing pass. In such examples, the second amount may be more than the first amount.

Table 2 below includes an example of a number of drops of print agent to be deposited (during a spitting procedure) from each nozzle in a particular subset of nozzles in a scenario such as that shown in FIG. 4. In this example, the print head 102 comprises four subsets of nozzles, such that four passes of the print head depositing print agent would cause a single swath to be formed on the substrate 100. Pass 1 is considered to be the particular printing pass determined at block 204 of the method 200. In this example, therefore, pass 1 is considered to be the first printing pass to deposit print agent over entire printable width of the substrate 100 following the printing of the last swath to include the unprinted region 404.

TABLE 2

| Nozzle Subset | Drops to spit prior to pass 1 | Drops to spit prior to pass 2 | Drops to spit prior to pass 3 | Drops to spit prior to pass 4 | Drops to spit prior to pass 5 | Drops to spit prior to pass 6+ |
|---|---|---|---|---|---|---|
| 1 | 20 | 20 | 20 | 20 | 20 | 20 |
| 2 | 200 | 20 | 20 | 20 | 20 | 20 |
| 3 | 200 | 200 | 20 | 20 | 20 | 20 |
| 4 | 200 | 200 | 200 | 20 | 20 | 20 |

In this example, in the printing passes prior to the particular printing pass (i.e. pass 1), all of the subsets of nozzles are to have deposited print agent onto the substrate 100 in a swath which includes the unprinted area 404. When the print head is to print the swath corresponding to the band 406, the amount of print agent to be deposited increases significantly. Therefore, prior to pass 1 (the particular pass), during which the first subset of nozzles would deliver significantly more print agent than in the preceding printing pass, a relatively large amount of spitting is to be performed by the nozzles of the second, third and fourth subsets of nozzles to at least approximately maintain a temperature in the nozzles, as they are still to print a swath that includes the unprinted region 406. A relatively smaller amount of print agent is to be deposited from the first subset of nozzles (20 drops from each nozzle in this example) compared to the amount of print agent to be deposited from the other subsets of nozzles (200 drops from each nozzle in this example).

After pass 1, and prior to pass 2, during which the second subset of nozzles is to deposit print agent onto the substrate 100 in the band 406, nozzles of the second subset are to spit a relatively smaller amount of print agent (20 drops from each nozzle in this example) along with the nozzles of the first subset as they are both to deposit a relatively larger amount of print agent onto the substrate 100. Similarly, after pass 2, and prior to pass 3, during which the third subset of nozzles is to deposit print agent onto the substrate 100 in the band 406, nozzles of the third subset are to spit a smaller amount (20 drops) and after pass 3, and prior to pass 4, during which the fourth subset of nozzles is to deposit print agent onto the substrate 100 in the band 406, nozzles of the fourth subset are to spit a smaller amount (20 drops).

After pass 4, the subsets of nozzles are to deposit equal (relatively large) amounts of print agent onto the substrate 100 in subsequent printing passes, so each subset of nozzles is caused to spit an equal (relatively small) amount of print agent prior to each subsequent printing pass.

Thus, preparing a schedule (block 206 of method 200) may further comprise scheduling the first subset of the plurality of subsets of nozzles to spit a third amount of print agent after the particular printing pass, and prior to a printing pass immediately following the particular printing pass; and scheduling the second subset of the plurality of subsets of nozzles to spit a fourth amount of print agent after the particular printing pass, and prior to the printing pass immediately following the particular printing pass. In some examples, such as the example discussed above with reference to Table 2, the third amount may be the same as the fourth amount.

In an example in which condition (ii) is met (for example, as shown in FIG. 5), the second amount may be less than the first amount. In other words, in some examples, the particular printing pass may comprise a printing pass to print a swath which is the first of a plurality of adjacent swaths in which each swath has an area coverage exceeding a defined threshold. In such examples, the second amount may be less than the first amount.

Table 3 below includes an example of a number of drops of print agent to be deposited (during a spitting procedure) from each nozzle in a particular subset of nozzles in a scenario such as that shown in FIG. 5. In the example, the print head 102 comprises four subsets of nozzles, such that four passes of the print head depositing print agent would cause a single swath to be formed on the substrate 100. Pass 1 is considered to be the particular printing pass determined to meet condition (ii) at block 204 of the method 200. In this example, therefore, pass 1 is considered to be the first printing pass of the print head to print the first swath in the band 506.

TABLE 3

| Nozzle Subset | Drops to spit prior to pass 1 | Drops to spit prior to pass 2 | Drops to spit prior to pass 3 | Drops to spit prior to pass 4 | Drops to spit prior to pass 5 | Drops to spit prior to pass 6+ |
|---|---|---|---|---|---|---|
| 1 | 1500 | 20 | 20 | 20 | 20 | 20 |
| 2 | 20 | 1500 | 20 | 20 | 20 | 20 |
| 3 | 20 | 20 | 1500 | 20 | 20 | 20 |
| 4 | 20 | 20 | 20 | 1500 | 20 | 20 |

In this example, the particular printing pass (i.e. pass 1) is the first printing pass of the first swath of a plurality of swaths. In each of the plurality of swaths, a relatively large amount (and an approximately consistent amount) of print agent is to be deposited onto the substrate 100. Prior to pass 1, in some examples, none of the subsets of nozzles may have deposited print agent for some time and, therefore, the temperature of those nozzles may be relatively low. Thus, prior to pass 1 (the particular pass), during which the first subset of nozzles are to deliver a relatively large amount of print agent, a relatively large amount of spitting is to be performed by the nozzles of the first subset of nozzles (1500 drops from each nozzle in this example) in order to increase the temperature in the nozzles. A relatively smaller amount of print agent is to be deposited from the other subsets of nozzles (20 drops from each nozzle in this example) as those nozzles are not to deposit print agent onto the substrate 100 during pass 1.

After pass 1, and prior to pass 2, during which the second subset of nozzles is to deposit print agent onto the substrate 100 in the band 506, nozzles of the second subset are to spit a relatively larger amount of print agent (1500 drops from each nozzle in this example) as they are to deposit a relatively larger amount of print agent onto the substrate 100. Nozzles of the first subset are to spit a smaller amount (20 drops) after the first pass as those nozzles are to deposit a large amount of print agent onto the substrate 100 during pass 1 and, therefore, the temperature of those nozzles is high. After pass 2, and prior to pass 3, during which the third subset of nozzles is to deposit print agent onto the substrate 100 in the band 506, nozzles of the third subset are to spit a larger amount (1500 drops) and after pass 3, and prior to pass 4, during which the fourth subset of nozzles is to deposit print agent onto the substrate 100 in the band 506, nozzles of the fourth subset are to spit a larger amount (1500 drops).

After pass 4, the subsets of nozzles are to deposit equal (relatively large) amounts of print agent onto the substrate 100 in subsequent printing passes, so each subset of nozzles is caused to spit an equal (relatively small) amount of print agent (20 drops in this example) prior to each subsequent printing pass.

Thus, preparing a schedule (block 206 of method 200) may further comprise scheduling the first subset of the plurality of subsets of nozzles to spit a third amount of print agent after the particular printing pass, and prior to a printing pass immediately following the particular printing pass; and scheduling the second subset of the plurality of subsets of nozzles to spit a fourth amount of print agent after the particular printing pass, and prior to the printing pass immediately following the particular printing pass. In some examples, such as the example discussed above with reference to Table 3, the third amount may be less than the fourth amount. In some examples, such as the example discussed above with reference to Table 3, the first amount may be the same as the fourth amount, and the second amount may be the same as the third amount.

In some examples, the particular pass (i.e. the particular pass of block 204) may comprise one of a plurality of printing passes to be performed during a print job. In some examples, an amount of spitting to be performed during the nozzle spitting procedure may be determined based on an amount of print agent to be deposited on the printable medium (such as the substrate 100) during the print job.

Figure 6:
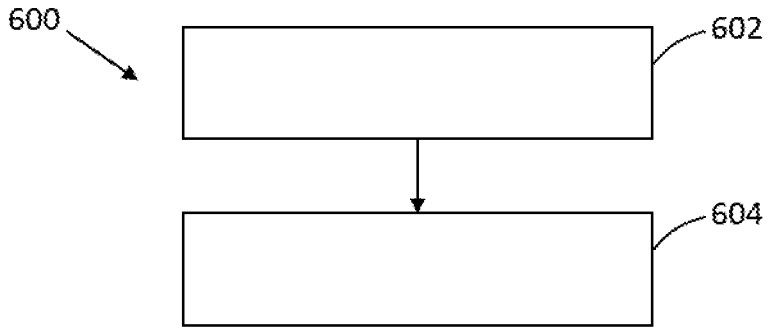
FIG. 6 is a flowchart of a further example of a method of controlling a print head of a printing apparatus.

FIG. 6 is a flowchart showing a further example of a method 600 for controlling a print head of a printing apparatus. More particularly, the method 600 may be for scheduling a spitting procedure for a print head 102. The method 600 may comprise, at block 602, performing said spitting procedure in accordance with said schedule. At block 604, the method 600 may comprise, following said performing of said scheduled spitting procedure, spitting an equal amount of print agent from each of the plurality of subsets of nozzles. Following the scheduled spitting procedure, the nozzles may be caused to perform a regular spitting procedure wherein all of the nozzles are to spit a relatively small amount of print agent.

Figure 7:
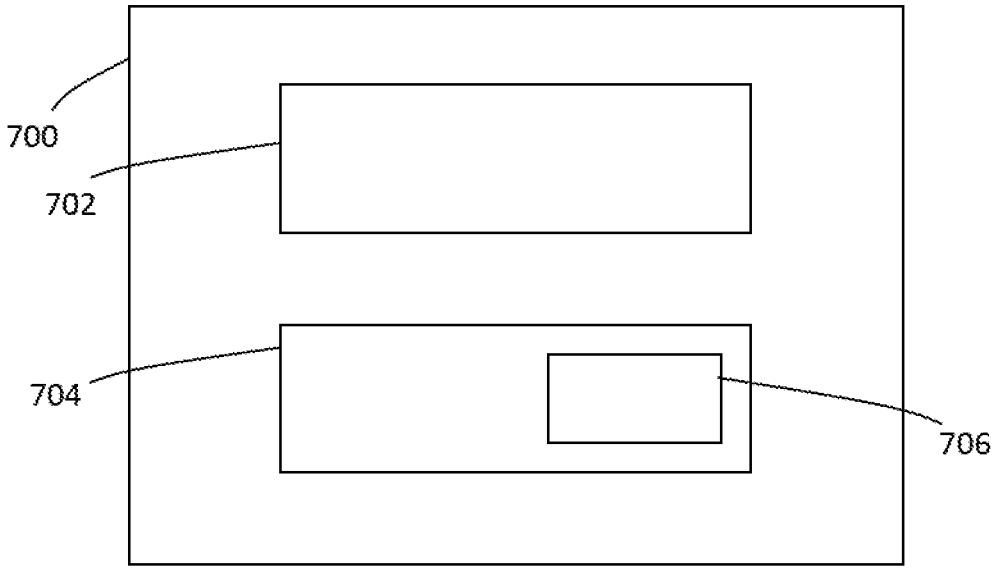
FIG. 7 is a schematic illustration of an example of a printing apparatus.

FIG. 7 is a schematic illustration of a print apparatus 700. The print apparatus 700 may be the print apparatus discussed above, portions of which are shown in FIGS. 1, 3, 4 and 5. The print apparatus 700 comprises a print agent distributor 702 (such as the print head 102) having a plurality of nozzles to deposit print agent onto a substrate 100 during successive printing passes. The print apparatus 700 further comprises a processor 704. The processor 704 may, in some examples, comprise an ascertaining module 706. The processor 704 may ascertain that the print head is to perform a particular printing pass which is one of: (i) a printing pass during which an amount of print agent to be deposited from nozzles of the print agent distributor differs, by an amount that exceeds a defined threshold, from an amount of print agent to be deposited from the nozzles during a printing pass immediately preceding said particular printing pass; and (ii) a printing pass to print a swath which is the first of a plurality of adjacent swaths in which each swath has an area coverage exceeding a defined threshold. The processor 704 may also devise a schedule for spitting print agent from the nozzles to commence before the print agent distributor 702 performs the particular printing pass. In some examples, the schedule may be devised based on a number of printing passes of the print agent distributor 702 to print a swath on the substrate.

Figure 8:
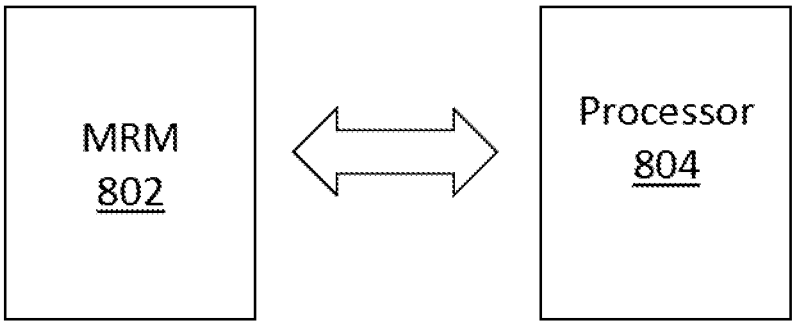
FIG. 8 is a schematic illustration of a machine-readable medium and a processor.

FIG. 8 shows a machine-readable medium 802 associated with a processor 804. The machine-readable medium 802 comprises instructions which, when executed by the processor 804, cause the processor 804 to receive data indicating of a number of printing passes of a print head to print a swath on a printable medium. The machine-readable medium 802 comprises instructions which, when executed by the processor 804, cause the processor 804 to ascertain that the print head is to perform a particular printing pass which is one of:

(i) a printing pass during which a number of drops of ink to be deposited from nozzles of the print head differs, by an amount that exceeds a defined threshold, from a number of drops of ink to be deposited from the nozzles during a printing pass immediately preceding said particular printing pass; and (ii) a printing pass to print a swath which is the first of a plurality of adjacent swaths in which each swath has an area coverage exceeding a defined threshold. The machine-readable medium 802 comprises instructions which, when executed by the processor 804, cause the processor 804 to prepare, based on said obtained information, a schedule for a nozzle spitting procedure to be commenced prior to the print head performing the particular printing pass.

Examples in the present disclosure can be provided as methods, systems (hardware or the like) or machine readable instructions to be executed by processing circuitry. Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, a or "an" does not exclude a plurality, and a single processor or other unit may fulfil the functions of several units recited in the claims.

The features of any dependent claim may be combined with the features of any of the independent claims or other dependent claims.

The invention claimed is:

1. A method comprising:

obtaining information indicative of a number of printing passes of a print head to print a swath on a printable medium;

determining that the print head is to perform a particular printing pass which is one of:

a printing pass during which an amount of print agent to be deposited from nozzles of the print head differs, by an amount that exceeds a defined threshold, from an amount of print agent to be deposited from the nozzles during a printing pass immediately preceding said particular printing pass; and a printing pass to print a swath which is the first of a plurality of adjacent swaths in which each swath has an area coverage exceeding a defined threshold; and preparing, based on said obtained information, a schedule for a nozzle spitting procedure to commence before the print head performs the particular printing pass.

2. A method according to claim 1, wherein the print head comprises a plurality of subsets of nozzles, and wherein said preparing a schedule comprises:

scheduling a first subset of the plurality of subsets of nozzles to spit a first amount of print agent prior to the particular printing pass; and scheduling a second subset of the plurality of subsets of nozzles to spit a second amount of print agent prior to the particular printing pass.

3. A method according to claim 2, wherein the first amount is different from the second amount.

4. A method according to claim 2, wherein the particular printing pass comprises a printing pass to print a swath which is the first of a plurality of adjacent swaths in which each swath has an area coverage exceeding a defined threshold; and wherein the second amount is less than the first amount.

5. A method according to claim 4, wherein said preparing a schedule further comprises:

scheduling the first subset of the plurality of subsets of nozzles to spit a third amount of print agent after the particular printing pass, and prior to a printing pass immediately following the particular printing pass; and scheduling the second subset of the plurality of subsets of nozzles to spit a fourth amount of print agent after the particular printing pass, and prior to the printing pass immediately following the particular printing pass;

wherein the third amount is less than the fourth amount.

6. A method according to claim 5, wherein the first amount is the same as the fourth amount, and the second amount is the same as the third amount.

7. A method according to claim 2, wherein the particular printing pass comprises a printing pass during which an amount of print agent to be deposited from nozzles of the print head differs, by an amount that exceeds a defined threshold, from an amount of print agent to be deposited from the nozzles during a printing pass immediately preceding said particular printing pass; and wherein the second amount is less than the first amount.

8. A method according to claim 7, wherein said preparing a schedule further comprises:

scheduling the first subset of the plurality of subsets of nozzles to spit a third amount of print agent after the particular printing pass, and prior to a printing pass immediately following the particular printing pass; and scheduling the second subset of the plurality of subsets of nozzles to spit a fourth amount of print agent after the particular printing pass, and prior to the printing pass immediately following the particular printing pass;

wherein the third amount is the same as the fourth amount.

9. A method according to claim 2, wherein the particular printing pass comprises a printing pass during which an amount of print agent to be deposited from nozzles of the print head differs, by an amount that exceeds a defined threshold, from an amount of print agent to be deposited from the nozzles during a printing pass immediately preceding said particular printing pass; and wherein the first amount is less than the second amount.

10. A method according to claim 9, wherein said preparing a schedule further comprises:

scheduling the first subset of the plurality of subsets of nozzles to spit a third amount of print agent after the particular printing pass, and prior to a printing pass immediately following the particular printing pass; and scheduling the second subset of the plurality of subsets of nozzles to spit a fourth amount of print agent after the particular printing pass, and prior to the printing pass immediately following the particular printing pass;

wherein the third amount is the same as the fourth amount.

11. A method according to claim 1, wherein said particular pass comprises one of a plurality of printing passes to be performed during a print job; and wherein an amount of spitting to be performed during the nozzle spitting procedure is determined based on an amount of print agent to be deposited on the printable medium during the print job.

12. A method according to claim 1, further comprising:

performing said spitting procedure in accordance with said schedule.

13. A method according to claim 12, further comprising:

following said performing of said scheduled spitting procedure, spitting an equal amount of print agent from each of the plurality of subsets of nozzles.

14. A method according to claim 1, further comprising preparing the schedule for the nozzle spitting procedure based on the particular printing pass being a printing pass during which an amount of print agent to be deposited from nozzles of the print head differs, by an amount that exceeds a defined threshold, from an amount of print agent to be deposited from the nozzles during a printing pass immediately preceding said particular printing pass.

15. A method according to claim 1, further comprising preparing the schedule for the nozzle spitting procedure based on the particular printing pass being a printing pass to print a swath which is the first of a plurality of adjacent swaths in which each swath has an area coverage exceeding a defined threshold.

16. A method according to claim 1, further comprising:

determining that the particular printing pass is in a fill region of a print job; and preparing the schedule for the nozzle spitting procedure based on the determination that the particular printing pass is in a fill region of the print job.

17. A print apparatus comprising:

a print agent distributor having a plurality of nozzles to deposit print agent onto a substrate during successive printing passes; and a processor to:

determine when the print head is to perform a particular printing pass which is in a fill region of a print job; and devise a schedule for spitting print agent from the nozzles to commence before the print agent distributor performs the particular printing pass based on whether the particular printing pass is in a fill region of the print job.

18. A printing apparatus according to claim 17, wherein the processor is further to determine whether the particular printing pass uses an amount of print agent to be deposited from nozzles of the print agent distributor that differs, by an amount that exceeds a defined threshold, from an amount of print agent to be deposited from the nozzles during a printing pass immediately preceding said particular printing pass.

19. A printing apparatus according to claim 17, wherein the processor is further to determine whether the particular printing pass is to print a swath which is the first of a plurality of adjacent swaths in which each swath has an area coverage exceeding a defined threshold.

20. A machine-readable medium comprising instructions which, when executed by a processor, cause the processor to:

receive data indicating of a number of printing passes of a print head to print a swath on a printable medium;

ascertain that the print head is to perform a particular printing pass meeting a criterion comprising one of:

a printing pass during which a number of drops of ink to be deposited from nozzles of the print head differs, by an amount that exceeds a defined threshold, from a number of drops of ink to be deposited from the nozzles during a printing pass immediately preceding said particular printing pass; and a printing pass to print a swath which is the first of a plurality of adjacent swaths in which each swath has an area coverage exceeding a defined threshold; and in response to ascertaining that the particular printing pass meets the criterion, prepare, based on said obtained information, a schedule for a nozzle spitting procedure to be commenced prior to the print head performing the particular printing pass.

* * * * *